United States Patent [19]

de Palau

[11] 4,172,424

[45] Oct. 30, 1979

[54] WALL SAFE WITH SECRET COMPARTMENT

[76] Inventor: Manuel F. de Palau, Sor Eulalia Anzizu, Street No. 40, Barcelona, Spain

[21] Appl. No.: 912,923

[22] Filed: Jun. 5, 1978

[30] Foreign Application Priority Data

Jun. 14, 1977 [ES] Spain ..... 229.279

[51] Int. Cl.[2] ..... E05G 1/06

[52] U.S. Cl. ..... 109/50; 109/54; 109/79; 312/107; 312/204

[58] Field of Search ..... 109/50, 51, 52, 53, 109/54, 56, 57, 64, 79; 49/388; 312/108, 111, 107, 204

[56] References Cited

U.S. PATENT DOCUMENTS

| | | | |
|---|---|---|---|
| 954,670 | 4/1910 | Damon | 109/53 |
| 976,067 | 11/1910 | Gilmore | 109/53 |
| 1,910,504 | 5/1933 | Sellman | 312/107 |
| 2,465,057 | 3/1949 | Brandes | 109/51 |
| 3,743,372 | 7/1973 | Ruggerone | 312/108 |
| 3,778,932 | 12/1973 | Ewing | 49/388 |

FOREIGN PATENT DOCUMENTS

| | | | |
|---|---|---|---|
| Ad.34860 | 10/1929 | France | 109/54 |

*Primary Examiner*—David H. Corbin

*Attorney, Agent, or Firm*—Blanchard, Flynn, Thiel, Boutell & Tanis

[57] ABSTRACT

A wall-type safe provided with a main parallelepiped body defining therein a main storage chamber, the front side of the body being closed by a swingable door. One of the walls of the body has an enlarged opening formed therethrough, which wall exteriorly thereof has a pair of opposed guide flanges extending along opposite sides of the opening. A boxlike compartment which is open at one end, is provided with flanges along the open end which slidably engage the guide flanges on the body for connecting the compartment thereto, whereby the compartment defines therein a secret chamber accessible solely from the main chamber. An interior wall is disposed in the main chamber and overlies the opening for covering and closing same, which interior wall is removable when access to the secret chamber is desired.

3 Claims, 4 Drawing Figures

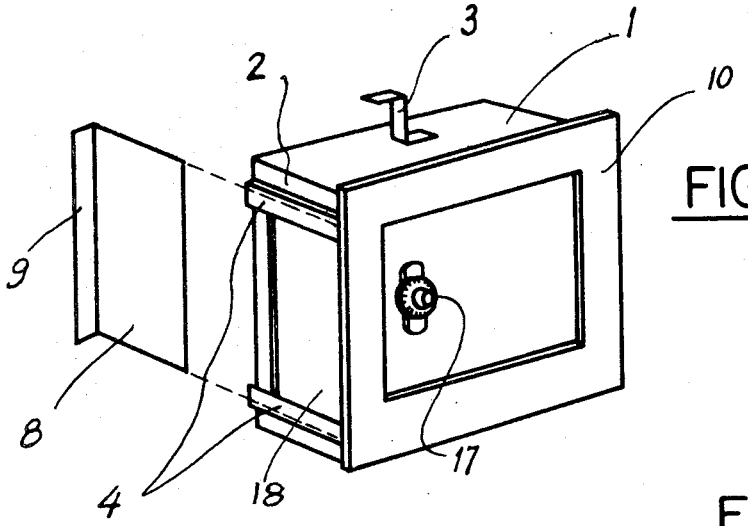
FIG. 1
FIG. 3
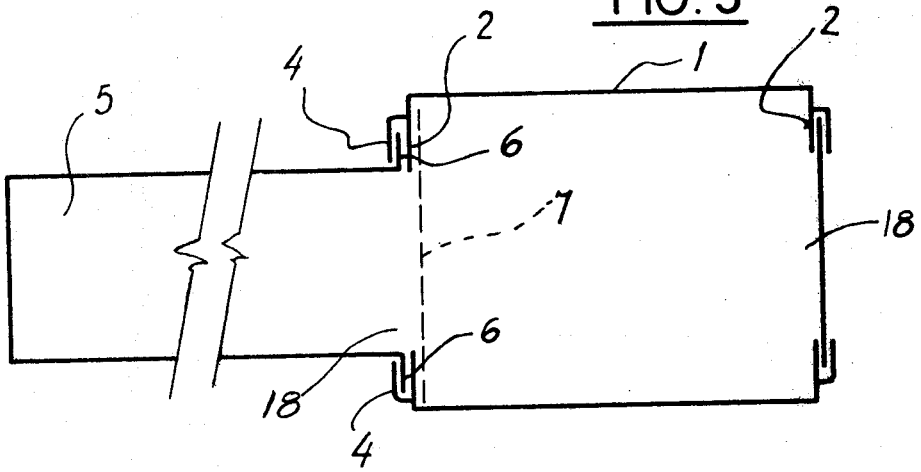
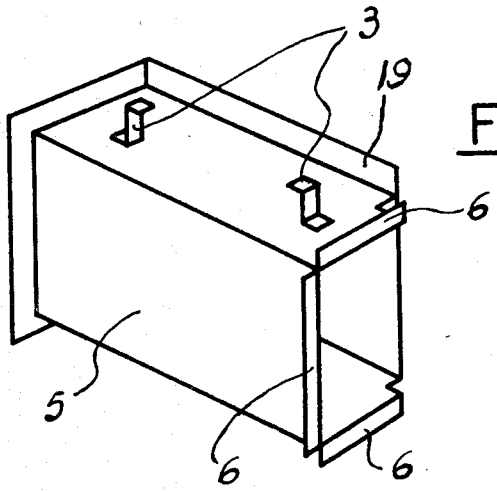
FIG. 2

WALL SAFE WITH SECRET COMPARTMENT

The present invention relates to an improved wall-type safe comprising secret additional compartments accessible through removable walls of the safe.

The safe in question has been ideated and realised for overcoming disadvantages in the prior art, as in the already known safes the secret compartments are fixedly attached to the safe. The safe of this invention uses removable compartments which can be selectively provided on both sides in T- or cross-form.

Broadly it is an object of the present invention to provide on the open sides some guides for removable compartments having flanges combined with said guides, which compartments can be reached through the extraction of the walls foreseen in the interior of the safe, comprising walls which are applicable exteriorly when not using the removable compartments. The referred safe has fastening elements for securing the safe within a building wall, these also existing on the removable compartments. The door of the safe can be removed by means of movable joints of the type like a safety bolt.

An example of embodiment of the invention will now be described with reference to the accompanying drawings in which:

FIG. 1 is a perspective view of the safe illustrating one of the removable walls.

FIG. 2 corresponds to a perspective view illustrating one of the removable compartments.

FIG. 3 is a sectioned elevational view of the safe with a compartment added to one side thereof.

Figure 4:
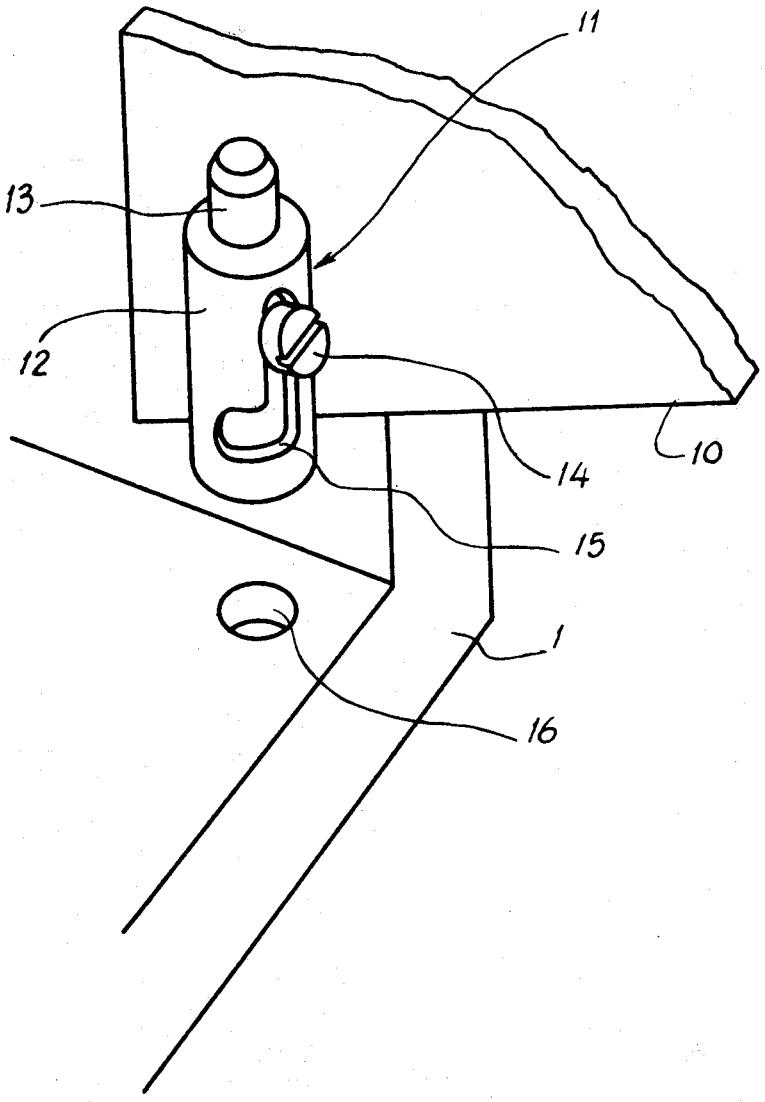
FIG. 4 is a fragmentary perspective detail illustrating the disposition of the joint allowing removal of the door of the safe.

Reference is now made to the drawings wherein there is shown the safe generally designated 1, consisting in a resistant metallic rectangular parallelepiped body having opposed side walls 2 defining therein two openings 18, the safe being provided in the upper part thereof with an element or tab 3 for fixing the safe within a building wall.

The safe side walls 2 have a pair of L-shaped guides 4 fixed thereto, which guides are disposed in opposed relationship adjacent the opposite edges of the opening 18. The guides 4 permit a boxlike compartment 5 to be added to the safe. The compartment 5 is formed by two resistant metallic laminar bodies, including the flanges 6 for confinement with the guides 4. The compartment 5 also has elements 3 for the fastening of the safe into the building wall. Compartment 5 also has flanges 19 for embedding the compartment within the building wall.

The safe also includes removable interior walls 7 to be fixed in a removable way to the inner side of the sidewall 2 by any means, as adhesive, magnet or the like. The walls 7 close the openings 18 of the walls 2 but are individually removable to allow access to the compartments 5.

The safe has as well some exterior walls 8 of a suitable resistant material to be applied in a removable way by gliding on the guides 4 to close the openings 18 in walls 2 when the compartments 5 are not being used. The walls 8 have flanges 9 for anchoring into the building wall.

The safe has a door 10 movable by means of two interior bolts generally designated 11, comprising the cylindrical body 12 a displaceable bar 13 having a screw 14 as guidance through the opening 15 of the body 12, which rod or bar is inserted into an opening 16 on the bottom and upper wall of the safe and which is retainable with possibility of articulation by means of the screw 14. The referred door 10 has the closure 17 provided with the convenient combination system.

The upper and lower walls of the safe may be formed as the sides, i.e. they may be open and provided with guides 4 for coupling the secret additional compartments 5 thereto.

It is understood that the invention can be worked under different realisation forms without altering the spirit and scope of the invention herein. Consequently the safe can be construed with any shape and size and with the most convenient materials.

What is claimed is:

1. Improvements in a wall-type safe including a main rectangular parallelepiped body defined by top, bottom, rear and side walls, said body defining therein a main storage chamber, and a door hingedly connected to said body for closing the front side thereof, comprising the improvement wherein at least one of said walls has an enlarged opening formed therein, a pair of parallel L-shaped guides fixed to the exterior of said one wall adjacent the opposite edges of said opening, a boxlike compartment removably attached to said main body for defining therein a secret storage chamber, said boxlike compartment being open at one end thereof and having a pair of parallel guide flanges fixed thereto adjacent the opposite sides of said open end, said guide flanges being slidably received within the pair of L-shaped guides secured to said one wall for connecting said compartment to said main body, whereby the open end of said compartment is in communication with the opening in said one wall so that said secret chamber is accessible solely from said main storage chamber through said opening, an interior wall disposed within said main chamber and positioned directly adjacent said one wall so as to totally overlie and close said opening, said interior wall being removable for permitting access to said secret chamber, and a removable exterior wall slidably supported by said pair of L-shaped guides for closing said opening when the compartment is not attached to said main body.

2. A safe according to claim 1, wherein at least a second said wall has an enlarged opening therethrough and is also provided with a pair of exterior L-shaped guides fixed thereto and disposed on opposite sides of said opening for permitting a further said compartment to be removably attached to said body, and a further said interior wall disposed within said main chamber so as to overlie said second wall to thereby close the opening therein.

3. A safe according to claim 1, wherein said main body and said compartment are each provided with outwardly projecting flanges or elements for securing the safe within a building wall.

* * * * *